US010486289B2

(12) United States Patent
Erbrick

(10) Patent No.: US 10,486,289 B2
(45) Date of Patent: Nov. 26, 2019

(54) TOOL WITH MECHANISM FOR WEAR ADJUSTMENT

(71) Applicant: Electroline Corporation, Pipersville, PA (US)

(72) Inventor: Robert S. Erbrick, Pipersville, PA (US)

(73) Assignee: Electroline Corporation, Pipersville, PA (US)

( * ) Notice: Subject to any disclaimer, the term of this patent is extended or adjusted under 35 U.S.C. 154(b) by 147 days.

(21) Appl. No.: 15/626,561

(22) Filed: Jun. 19, 2017

(65) Prior Publication Data

US 2018/0361543 A1 Dec. 20, 2018

(51) Int. Cl.

| | |
|---|---|
| ***B25B 7/18*** | (2006.01) |
| ***B25B 7/04*** | (2006.01) |
| ***B25B 7/12*** | (2006.01) |
| ***B25B 27/10*** | (2006.01) |

(52) U.S. Cl.

CPC ..... *B25B 7/18* (2013.01); *B25B 7/04* (2013.01); *B25B 7/12* (2013.01); *B25B 27/10* (2013.01)

(58) Field of Classification Search

CPC .... B25B 7/18; B25B 7/04; B25B 7/12; B25B 13/48; B25B 13/481; B25B 13/5091; B25B 17/00; E21B 19/16

See application file for complete search history.

(56) References Cited

U.S. PATENT DOCUMENTS

| | | | | |
|---|---|---|---|---|
| 2,483,713 | A * | 10/1949 | Seaver | B25B 13/5058 269/60 |
| 4,899,445 | A | 2/1990 | Erbrick et al. | |
| 5,307,565 | A | 5/1994 | Erbrick et al. | |
| 5,590,470 | A | 1/1997 | Erbrick et al. | |
| 6,178,643 | B1 | 1/2001 | Erbrick et al. | |
| 6,971,179 | B2 | 12/2005 | Erbrick | |
| 7,346,987 | B2 | 3/2008 | Erbrick | |
| 7,946,039 | B2 | 5/2011 | Erbrick | |
| 7,954,356 | B1 | 6/2011 | Erbrick et al. | |

* cited by examiner

*Primary Examiner* — Robert J Scruggs
(74) *Attorney, Agent, or Firm* — Panitch Schwarze Belisario & Nadel LLP

(57) ABSTRACT

An adjustment mechanism for a tool includes a first shroud pivotally attached to a first jaw of the tool and having a trough-shaped first body with a first gap and a first side section with a first aperture. A second shroud is pivotally attached to a second jaw and has a trough-shaped second body with a second gap and a second side section. An arm is pivotally attached to the first and second shrouds, disposed in the first and second gaps, and has a slot aligned with the first aperture and communicating with both a periphery and a pin mount of the arm. Rotatably mounted in the pin mount is a pin with a threaded aperture aligned with the slot. An adjustment screw passes through the first aperture and the slot and engages the threaded aperture. The screw head has a distal bearing surface restrained by the first side section.

15 Claims, 9 Drawing Sheets

TOOL WITH MECHANISM FOR WEAR ADJUSTMENT

BACKGROUND OF THE INVENTION

The present invention relates generally to hand tools and, more particularly, to a hand tool with jaws and a force-multiplying mechanism, and, still more particularly, to a mechanism for adjusting the force-multiplying mechanism and the jaws of the tool. The adjustment mechanism may be used to adjust the force-multiplying mechanism and the fit of the jaws to accommodate wear, to adjust the interaction of the jaws, or for other purposes.

In the field of hand tools, many tools include a pair of jaws that are pivotally connected to one another. The jaws are connected to handles that may be grasped by a user. The user exerts force on the handles to rotate the jaws toward each other, allowing the jaws to exert a compressive force on each other. The jaws may be adapted for cutting, crimping, or other purposes.

Some tools with jaws—for example, certain bolt cutters and crimpers—have compound mechanisms for aiding the user in applying large compressive forces between the jaws. In this class of tools, the handles of the tool are not attached directly to the jaws, and the jaws may or may not be pivotally attached directly to each other.

Referring to FIGS. 10 and 11, an exemplary tool according to the prior art has a pair of handles 414 attached to the input ends 324*a*, 342*a* of a pair of shrouds 324*a*, 342*b*, which are generally trough-shaped or U-shaped members. The output ends 324*b*, 342*b* of the shrouds 324, 342 are pivotally connected to and exert output forces upon the actuator arms 320, 322 of the jaws 314, 316. The jaws 314, 316 are pivotally attached to one another by a pivoting connection 318 as shown in FIG. 10 or alternatively are each pivotally attached to a third member. The user exerts an input force on the handles 414 over a first distance by pushing the handles 414 toward one another. At the output ends 324*b*, 342*b* of the pivotally attached shrouds 324, 342, the force exerted by the user over the first distance is multiplied and becomes an output force greater than the user's input force and exerted over a second, smaller distance. The force from the output ends 324*b*, 342*b* of the shrouds 324, 342 is preferably further multiplied into an output force greater still than the output force of the output ends 324*b*, 342*b* of the shrouds 324, 342. In this manner, the compound mechanism transforms the user's input force into a compressive output force many times higher than the user's input force.

The prior art tool 310 includes a adjustment mechanism, which allows the user to adjust the force-multiplying mechanism and the fit of the jaws 314, 316 by means of an arm 360 pivotally attached to the actuator arms 320, 322 of the jaws 314, 316 and secured near one end by an adjustment screw 378, as shown in FIG. 10. The adjustment screw 378 has a threaded portion, which engages with a threaded bore 381 in the arm 360 (see FIG. 11) and which passes through an opening (not shown) in the surface 325 of the shroud 324. The adjustment screw 378 also has a screw head engaging a surface 325 of the shroud 324 to fix or constrain the relationship between the jaws 314, 316. In such a mechanism, the connection between the threaded portion of the screw 378 and the threaded bore 381 tends to move the screw 378 to make contact with the lowermost portion of the opening; and the screw head also tends to contact the surface 325 of the shroud 324 at an angle so that the screw head 325 is not parallel to the surface 325. Under these conditions, the screw 378 is loaded substantially in bending rather than in tension. As a result, a user may inadvertently place a high level of bending stress on the adjustment screw 378, resulting in failure of the screw 378. Moreover, some prior tools include two such adjustment mechanisms, and users may find prior tools difficult to adjust.

In certain embodiments, the presently preferred invention is a tool having a single adjustment mechanism that allows adjustment of the force-multiplying mechanism and jaws of the tool, preferably through the manipulation of a single screw. The mechanism improves upon the mechanism of the prior art by pivotally coupling the adjustment screw to the arm in a manner that differs from the prior art and that preferably serves to cause the adjustment screw to be loaded primarily in tension, with the bearing surface of the screw head generally parallel to the surface of the shroud, thus reducing the stress placed on the adjustment screw. As a result of the reduced stress and the loading of the adjustment screw primarily in tension, in certain embodiments of the invention, the life of the adjustment screw is five times the life of the adjustment screws in comparable prior-art devices.

BRIEF SUMMARY OF THE INVENTION

Briefly stated, an adjustment mechanism is provided for a tool having a first jaw pivotally attached to a second jaw for exerting compressive force therebetween. The adjustment mechanism comprises a first shroud, which comprises a generally trough-shaped first body having a first generally planar front section. A first side section is joined to the first front section and has a first aperture therethrough. A first generally planar back section is joined to the first side section. The first side section holds the first front section and the first back section in generally parallel, spaced relation, with a first gap between the first front section and the first back section. The first shroud has a first end portion and a second end portion and is pivotally attached at the first end portion to the first jaw of the tool.

A second shroud comprises a generally trough-shaped second body having a second generally planar front section. A second side section is joined to the second front section. A second generally planar back section is joined to the second side section. The second side section holds the second front section and the second back section in generally parallel, spaced relation, with a second gap between the second front section and the second back section. The second shroud has a first end portion and a second end portion and is pivotally attached at the first end portion to the second jaw of the tool.

An arm has a first end portion, a second end portion, a medial portion disposed generally between the first end portion and the second end portion, and an outer periphery. The arm is disposed in the first gap and is pivotally attached to the first shroud at the medial portion of the arm to have a first range of pivotal motion between the arm and the first shroud and a first angular orientation between the arm and the first shroud. The arm has a pin mount in the second end portion thereof and a slot communicating with the outer periphery and intersecting the pin mount. The slot of the arm is aligned with the first aperture of the first side section. The arm is further disposed in the second gap and is pivotally attached to the second shroud at the first end portion of the second shroud.

A pin has a threaded aperture and is rotatably mounted in the pin mount of the arm with the threaded aperture aligned with the slot.

An adjustment screw has a threaded portion, a proximal end, a distal end, and a screw head at the proximal end. The screw head has a distal head portion and a distal bearing surface at the distal head portion. The distal end of the screw passes through the first aperture of the first shroud and the slot of the arm and threadedly engages the threaded aperture of the pin with the threaded portion of the adjustment screw. The distal bearing surface is restrained by the first side section of the first shroud. Upon rotation of the adjustment screw, at least one of the first range of pivotal motion between the arm and the first shroud and the first angular orientation between the arm and the first shroud is adjusted.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
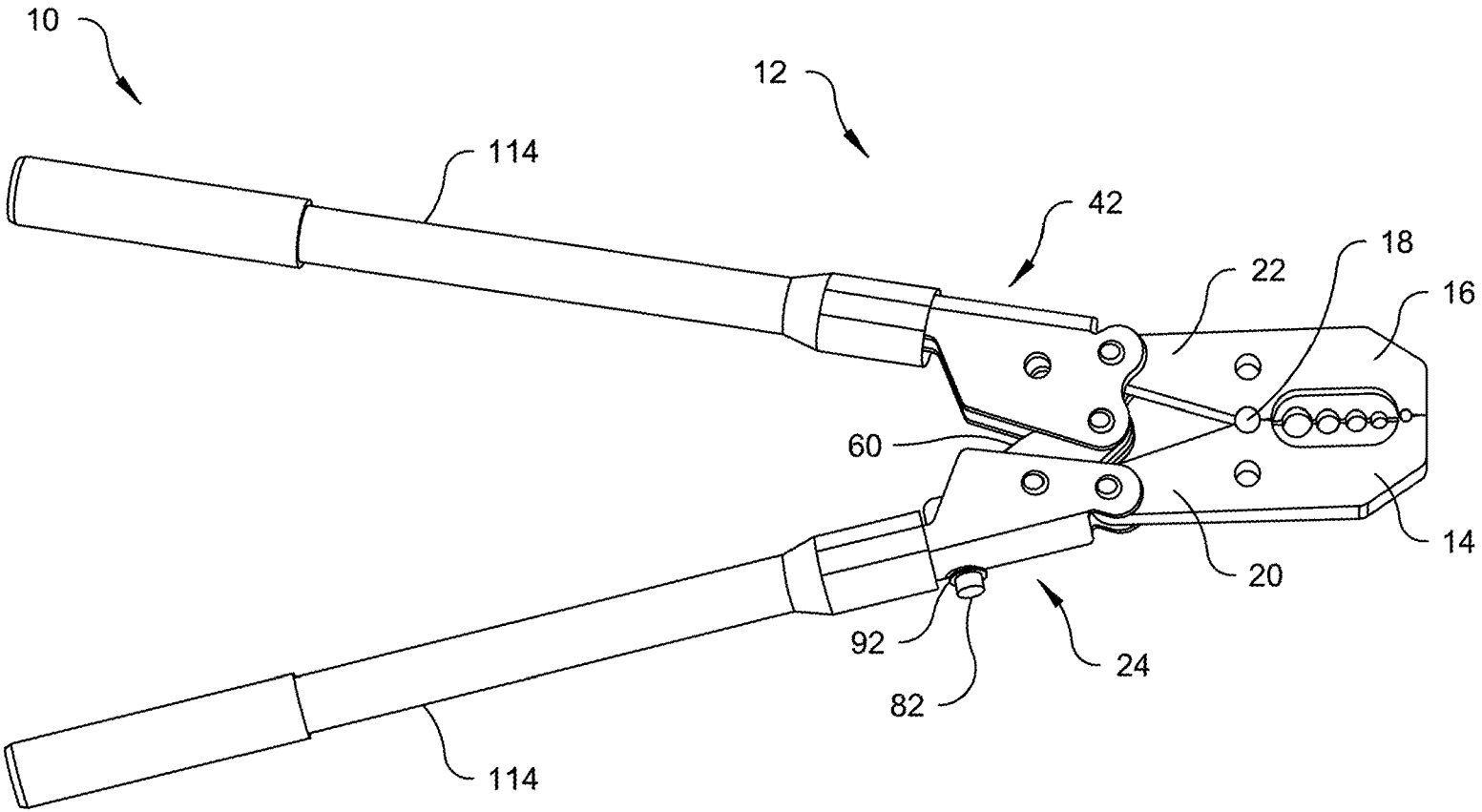
FIG. 1 is a rotated front elevational view of a tool according to a presently preferred embodiment of the invention.

Certain terminology is used in the following description for convenience only and is not limiting. Unless specifically set forth herein, the terms "a", "an" and "the" are not limited to one element but instead should be read as meaning "at least one". The words "right", "left", "lower" and "upper" designate directions in the drawings to which reference is made. The words "inwardly" or "distally" and "outwardly" or "proximally" refer to directions toward and away from, respectively, the geometric center of the device and related parts thereof. The terminology includes the above-listed words, derivatives thereof and words of similar import.

It should also be understood that the terms "about," "approximately," "generally," "substantially" and like terms, used herein when referring to a dimension or characteristic of a component of the preferred invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to FIGS. 1-9, a preferred embodiment of the present invention is directed to a mechanism 12 for wear adjustment (hereinafter sometimes called an "adjustment mechanism") for a tool 10. The tool 10 tool has a first jaw 14 pivotally attached by a pinned connection 18 to a second jaw 16 for exerting compressive force between the first jaw 14 and the second jaw 16. Except where otherwise specified, throughout this application, pivotal attachments may be made by pins, bolts, shafts, or any other items that may function is the manner of a pin or bolt in a pinned connection. The first jaw 14 has a first actuator arm 20, and the second jaw 16 has a second actuator arm 22. The first and second actuator arms 20, 22 are respectively fixed to, and as shown are preferably integrally formed with, the first and second jaws 14, 16.

Figure 2:
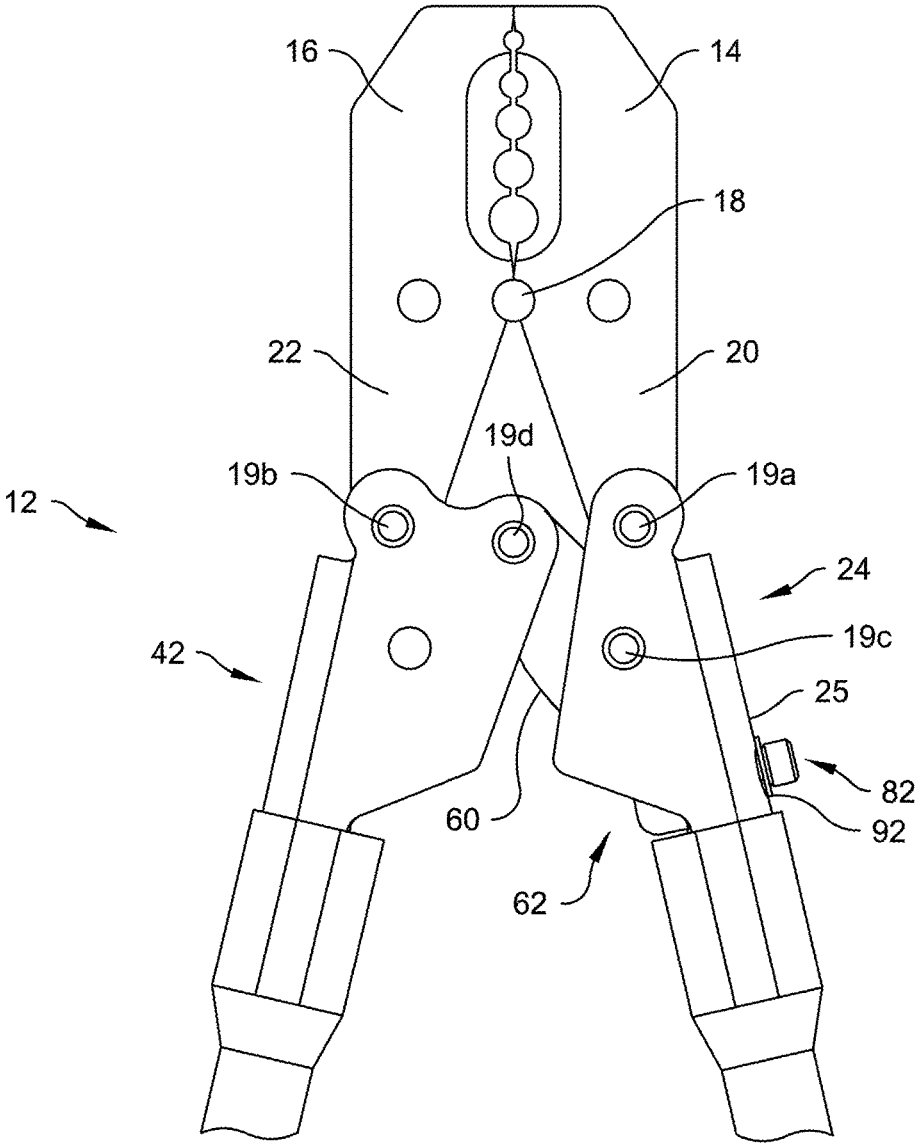
FIG. 2 is a front elevational view of the adjustment mechanism and jaws of the tool of FIG. 1.
Figure 3:
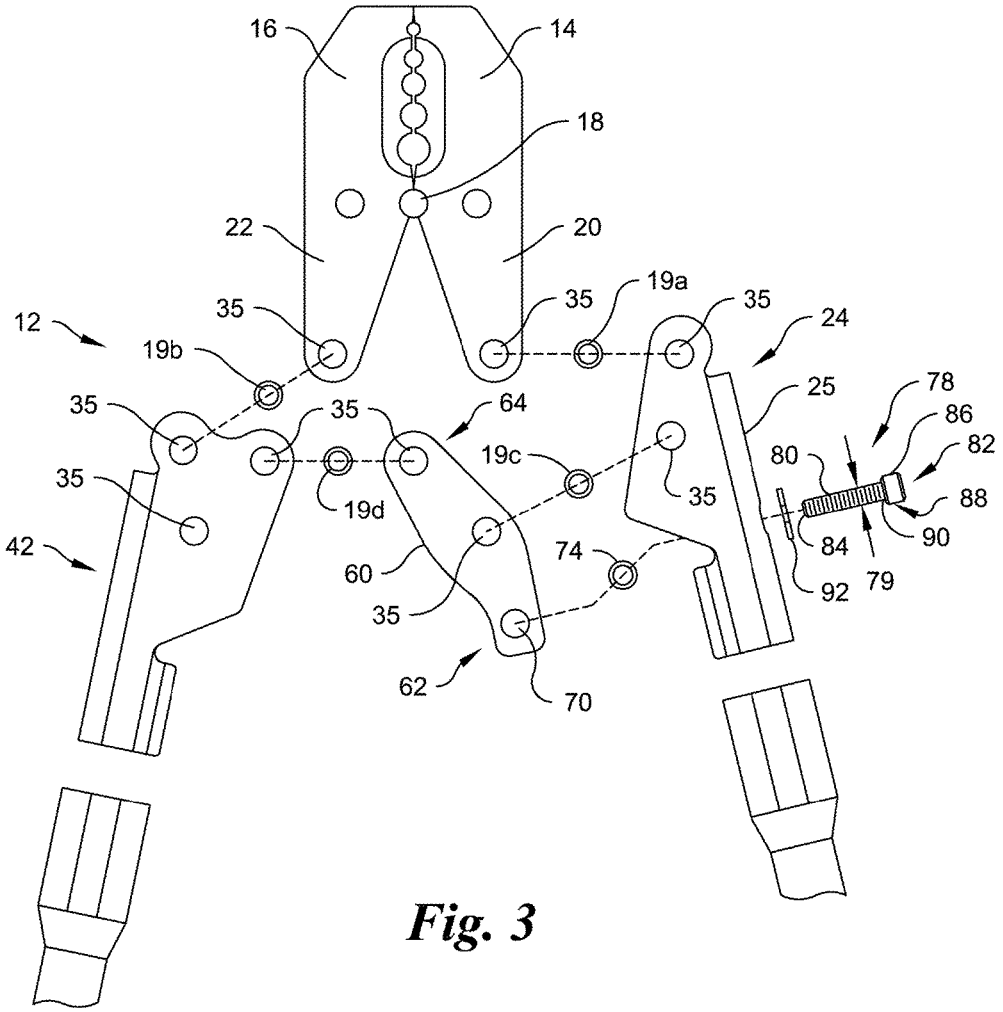
FIG. 3 is an exploded front elevational view of the adjustment mechanism and jaws of the tool of FIG. 1.
Figure 4:
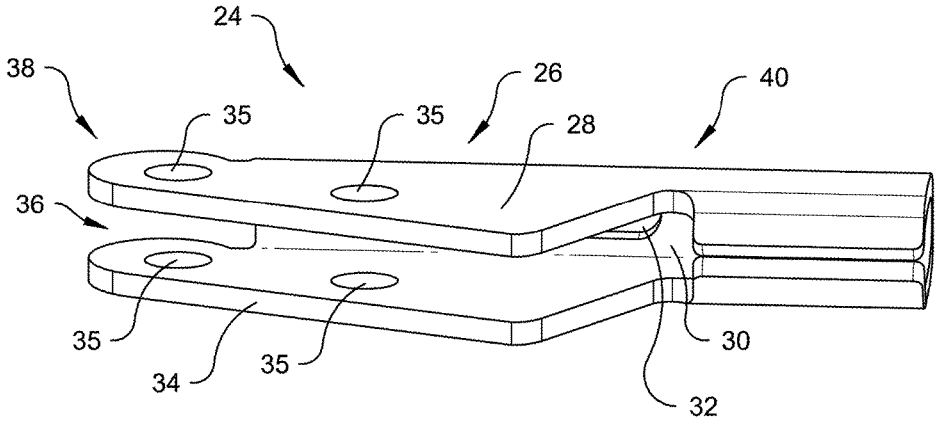
FIG. 4 is a left side perspective view of a first shroud of the adjustment mechanism of FIG. 2.

Referring to FIGS. 2, 3, and 4, a first shroud 24 comprises a generally trough-shaped first body 26. The first body 26 has a first generally planar front section 28, a first side section 30 joined to the first front section 26 and having a first aperture 32 therethrough, and a first generally planar back section 34 joined to the first side section 30. The shroud 24 has apertures 35 to accommodate pins or other hardware for attaching the shroud 24 to other portions of the adjustment mechanism 12 or to one of the jaws 14, 16. The first side section 30 holds the first front section 28 and the first back section 34 in generally parallel, spaced relation, with a first gap 36 between the first front section 28 and the first back section 34. The first shroud 24 has a first end portion 38 and a second end portion 40 and is pivotally attached at the first end portion 38 to the first jaw 14 of the tool 10 by a pin 19*a*. The second end portion 40 is secured to a handle 114. The first end portion 38 and the second end portion 40 are not limited to the extreme ends of the first shroud 24 and instead refer to portions of the first shroud 24 that are nearer one longitudinal end of the shroud 24 than to the other end. The first shroud 24 and may be formed by a plurality of generally planar bodies, but the first shroud 24 is preferably formed so that the first front section 28, the first side section 30, and the first back section 34 form a continuous unitary body having a generally U-shaped cross section.

Figure 5:
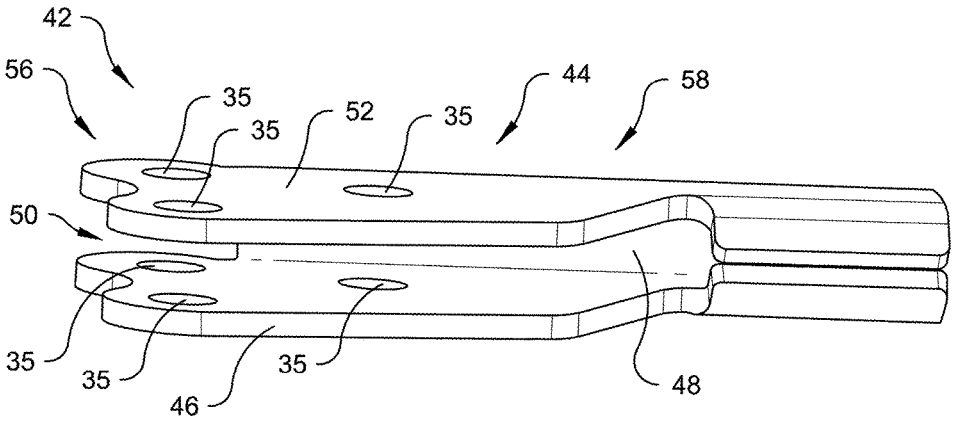
FIG. 5 is a right side perspective view of a second shroud of the adjustment mechanism of FIG. 2.

Referring to FIGS. 2, 3, and 5, a second shroud 42 comprises a generally trough-shaped second body 44. The second body 44 has a second generally planar front section 46, a second side section 48 joined to the second front section 46, and a second generally planar back section 52 joined to the second side section 48. The shroud 42 has apertures 35 to accommodate pins or other hardware for attaching the shroud 42 to other portions of the adjustment mechanism 12 or to one of the jaws 14, 16. The second side section 48 holds the second front section 46 and the second back section 52 in generally parallel, spaced relation, with a second gap 50 between the second front section 46 and the second back section 52. The second shroud 42 has a first end portion 56 and a second end portion 58 and is pivotally attached by a pin 19*b* at the first end portion 56 to the second jaw 16 of the tool 10. The second end portion 58 is secured to a handle 114. The first end portion 56 and the second end portion 58 are not limited to the extreme ends of the second shroud 42 and instead refer to portions of the second shroud 42 that are nearer one longitudinal end of the second shroud 42 than to the other end. The second shroud 42 and may be formed by a plurality of generally planar bodies, but the second shroud 42 is preferably formed so that the second front section 46, the second side section 48, and the second back section 52 form a continuous unitary body having a generally U-shaped cross section.

Referring to FIGS. 2, 3 and 6-8, the mechanism 12 also has a generally cam shaped arm 60 with a first end portion 62, a second end portion 64, a medial portion 66 disposed generally between the first end portion 62 and the second end portion 64, and an outer periphery 68. The arm 60 preferably comprises a first generally planar body of generally uniform thickness having a pin mount in the form of a mounting hole 70 and a slot 72 therein. The slot has an inner span 73. The first end portion 62 of the arm 60 has a preferably generally trapezoidal shape formed by the outer periphery 68 in combination with a demarcation line 63 between the first end portion 62 and the medial section 66. The second end portion 64 of the arm 60 also has a preferably generally trapezoidal shape formed by the outer periphery 68 in combination with a demarcation line 65 between the second end portion 64 and the medial section 66. The outer periphery 68 of the second end portion 64 is preferably rounded or curved at the second end 64*a*.

Referring again to FIGS. 1-9, the arm 60 is disposed in the first gap 36 and is pivotally attached to the first shroud 24 at the medial portion 66 of the arm 60 by a first pivotal connector. The first pivotal connector is preferably a bolt, a pin, or the like and is illustrated as a pin 19*c*. The pin 19*c* passes through the apertures 35 of the first front section 28 and the first back section 34 of the first shroud 24 and transversely through the aperture 35 of the medial portion 66 of the arm 60. At the pivotal connection between the arm 60 and the first shroud 24, there is a first range of pivotal motion and a first angular orientation between the arm 60 and the first shroud 24.

The arm 60 has a pin mount in the form of a mounting hole 70 in the first end portion 62 and a slot 72 communicating with the outer periphery 68 and intersecting the mounting hole 70. The slot 72 passes at least partially, and preferably entirely, through the arm 60. The slot 72 is aligned with the first aperture 32 of the first side section 30. The arm 60 is further disposed in the second gap 50 and is pivotally attached to the second shroud 42 at the first end portion 56. In some embodiments (not shown), the arm 60 may be pivotally attached to the second shroud 42 by a pin that also pivotally attaches the second shroud 42 to the second jaw 16. As shown in FIGS. 1-3, the arm 60 is preferably pivotally attached to the second shroud 42 by a pivotal connector distinct from the pivotal connector that attaches the second shroud 42 to the second jaw 16. The arm 60 is pivotally attached to the second shroud 42 by a pin 19*d*, and which passes through the apertures 35 of the second front section 46 and the second back section 52 of the second shroud 42 and transversely through the aperture 35 of the medial portion 66 of the arm 60.

Figure 6:
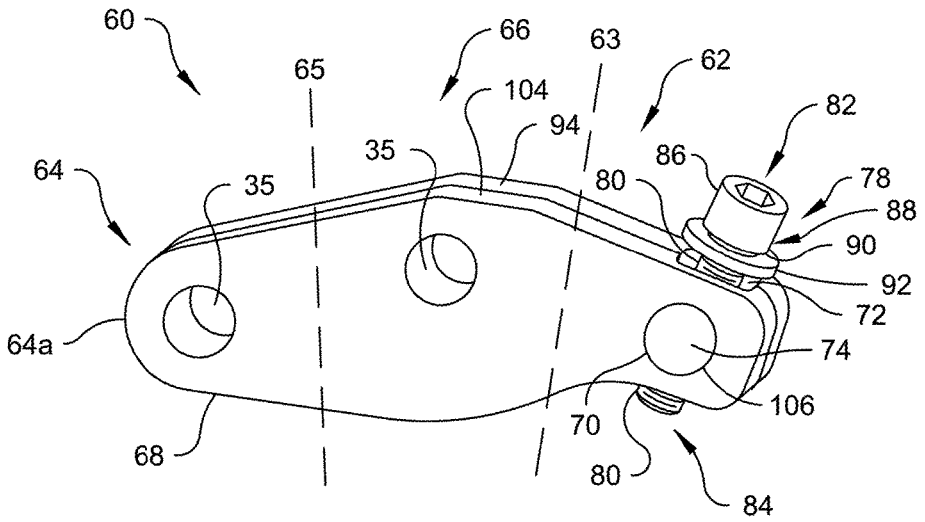
FIG. 6; is a front perspective view of an arm of the adjustment mechanism of FIG. 2.
Figure 7:
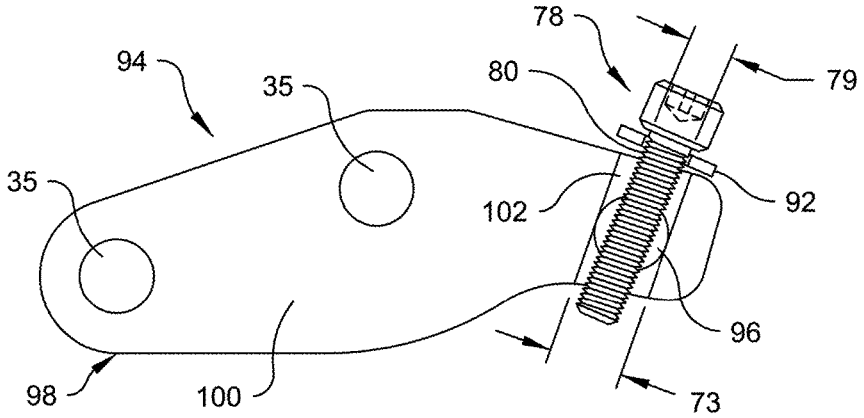
FIG. 7 is a front elevational view of the arm, a pin, and an adjustment screw of the adjustment mechanism of FIG. 2.
Figure 8:
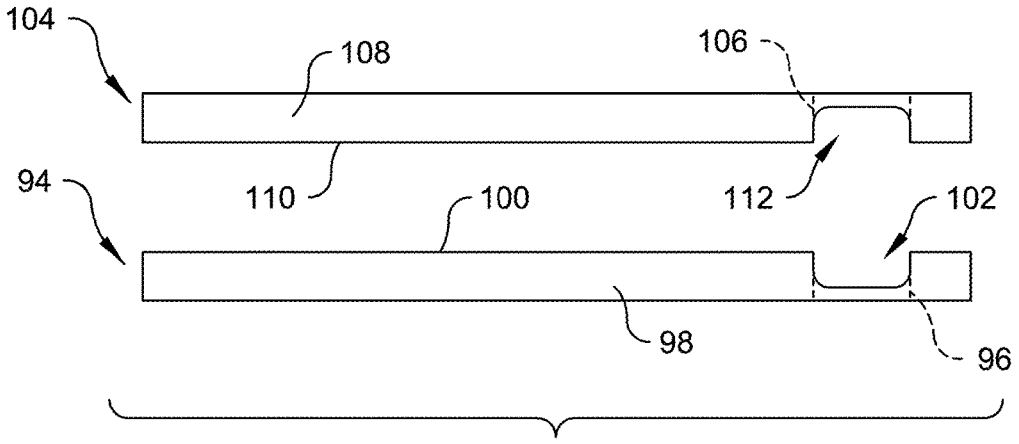
FIG. 8 is a bottom partial exploded plan view of the arm of FIG. 6.
Figure 9:
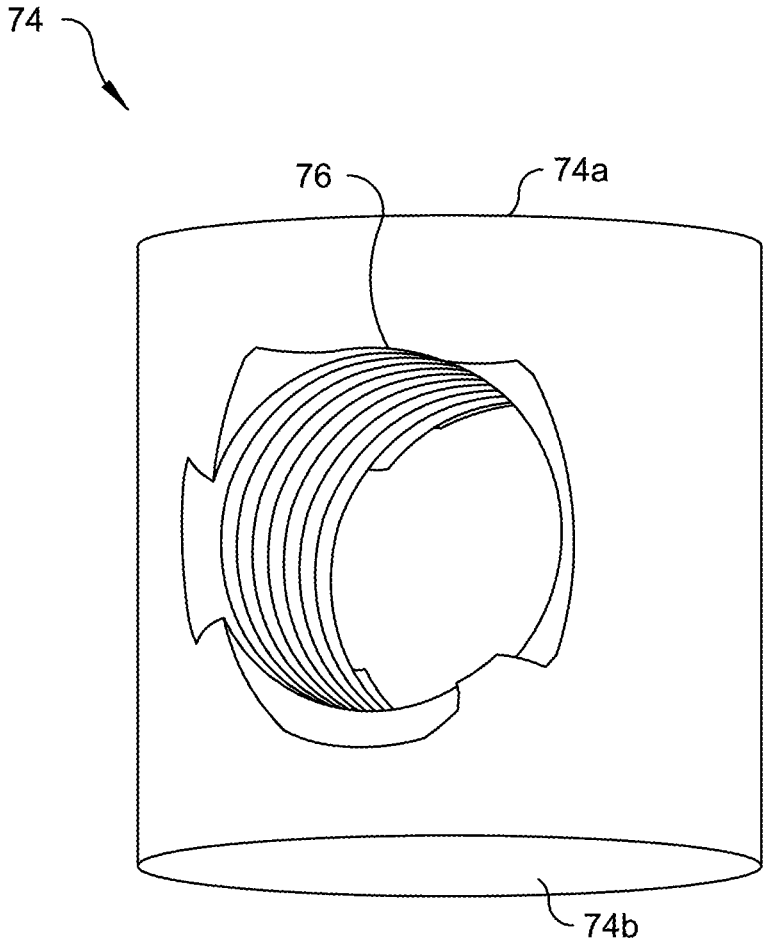
FIG. 9 is a perspective view of a pin with a threaded aperture of the adjustment mechanism of FIG. 2.
Figure 10:
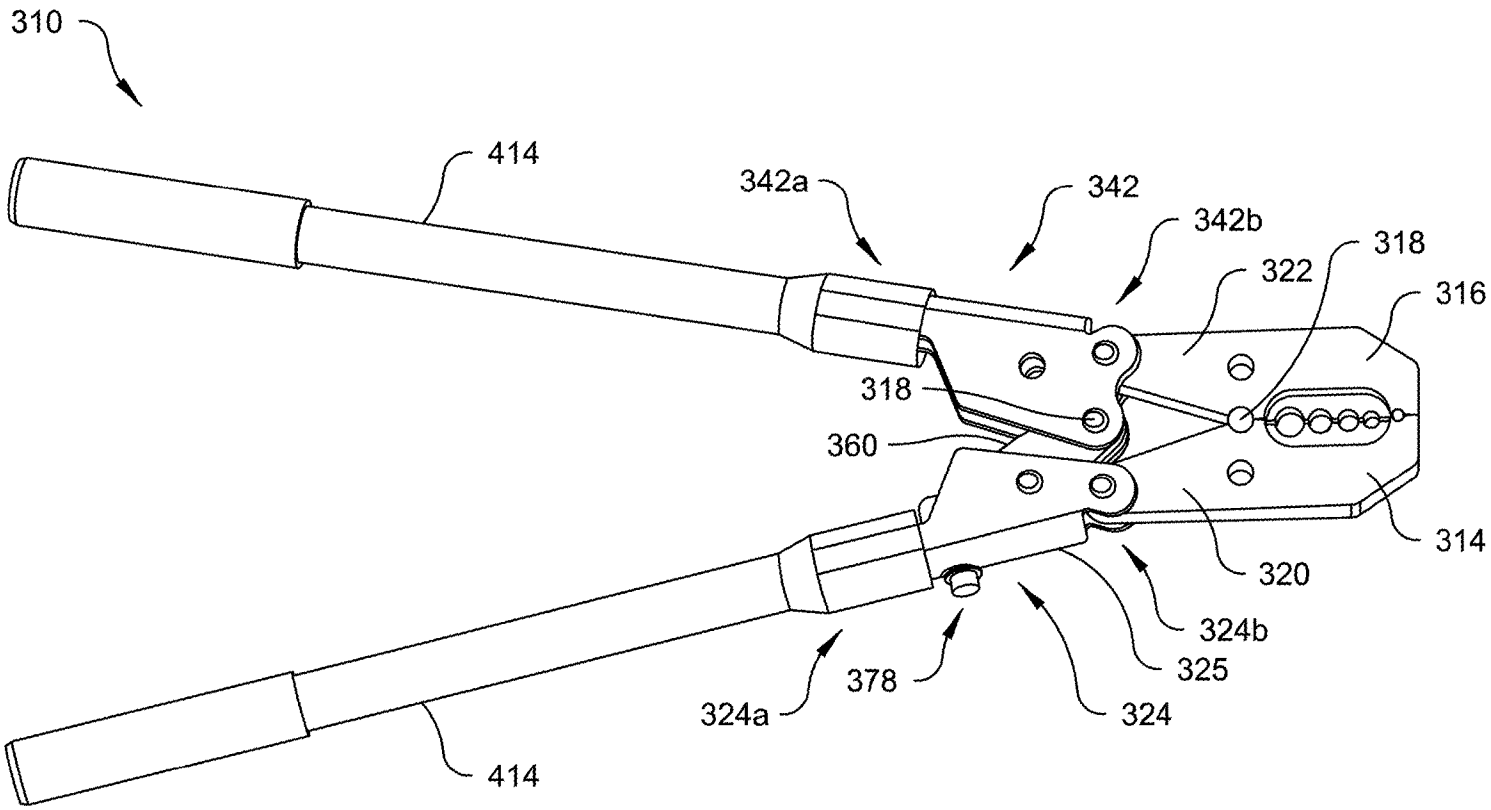
Fig. 10 (Prior Art)
FIG. 10 is a rotated front elevational view of a tool according to the prior art.
Figure 11:
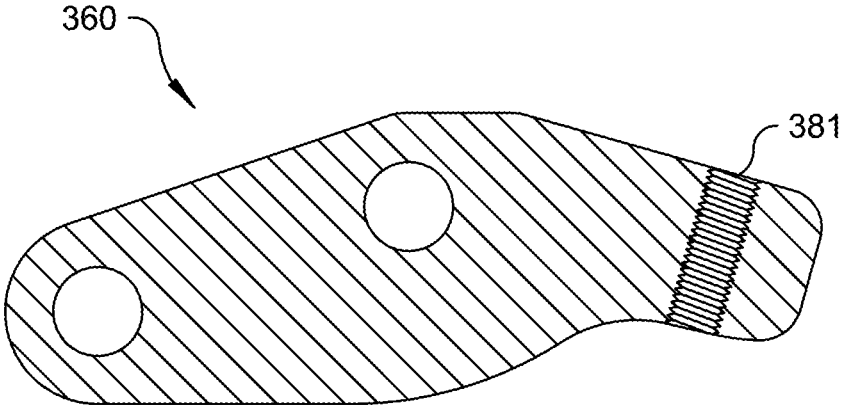
Fig. 11 (Prior Art)
FIG. 11 is a front sectional view of an arm of the tool of FIG. 10.

As shown in FIGS. 6-8, the arm 60 preferably comprises a first body 94 and a second body 104, which are mirror images of each other. The first body 94 is generally planar and of generally uniform thickness and has a pin mount in the form of a mounting hole 96, an outer periphery 98, and a generally planar first interior portion 100. A semi-slot 102 is formed in the first interior portion 100 and communicates with the mounting hole 96 and with the outer periphery 98 of the first body 94. The second generally planar body 104, preferably of generally uniform thickness, has a pin mount in the form of a mounting hole 106 aligned with the mounting hole 96 of the first body 94. The outer periphery 108 of the second body 104 is at least partially aligned with the outer periphery 98 of the first body 94. The second body 104 has a generally planar second interior portion 110. A semi-slot 112 is formed in the second interior portion 110 and communicates with the mounting hole 106 and with the outer periphery 108 of the second body 104. The first body 94 and the second body 104 are aligned so that the first interior portion 100 and the second interior portion 110 are adjacent. The semi-slot 102 formed in the first interior portion 100 and the semi-slot 112 formed in the second interior portion 110 are aligned to form the slot 72 communicating with the mounting hole 70 and with the outer periphery 68 of the arm 60. The mounting hole 96 of the first body 94 and the mounting hole 106 of the second body 104 are aligned and together form the mounting hole 70 of the arm 60. The pin 74 preferably has a first end 74*a* and a second end 74*b*, and the first end 74*a* preferably engages the mounting hole 96 of the first body 94, and the second end 74*b* engages the mounting hole 106 of the second body 104. Note that although each pin mount is depicted as a mounting hole 96, 106, each pin mount may also take the form of a depression or socket for mounting the pin 74. Preferably each semi-slot 102, 112, has a first intersection 102*a*, 112*a* and a second intersection 102*b*, 112*b* with the outer periphery 98, 108 of the respective first body 94 and second body 104, so that the slot 72 passes entirely through the arm 60.

Referring to FIGS. 6 and 7, a pin 74 with a threaded aperture 76 is rotatably mounted in the mounting hole 70 of the arm 60. The threaded aperture 76 is aligned with the slot 72 sufficiently that an adjustment screw 78 passes through the slot and engages the threaded aperture 76.

As shown in FIG. 3, the adjustment screw 78 has a threaded portion 80, a proximal end 82, a distal end 84, and a screw head 86 at the proximal end 82. The screw head 86 has a distal head portion 88 and a distal bearing surface 90 at the distal head portion 88. The distal end 84 of the screw 78 passes through the first aperture 32 of the first shroud 24 and the slot 72 of the arm 60. The threaded aperture 76 of the pin 74 threadedly engages with the threaded portion 80 of the adjustment screw 78. The distal bearing surface 90 of the adjustment screw 78 is restrained by an outer surface 25 of the first side section 30 of the first shroud 24, such that upon rotation of the adjustment screw 78, at least one of the first range of pivotal motion between the arm 60 and the first shroud 24 and the first angular orientation between the arm 60 and the first shroud 24 is adjusted.

Referring again to FIGS. 6 and 7, the adjustment screw 78 has an outer diameter 79. The inner span 73 of the slot 72 is at least slightly greater than the outer diameter 79 of the adjustment screw 78 such that the adjustment screw 78 pivots through a range of motion within the slot 79 and the first aperture 32. The inner span 73 of the slot 72 and the outer diameter 79 of the adjustment screw 78 are preferably selected so that the range of motion of the adjustment screw 78 within the slot 79 is within the range of about 15 to 20 degrees, measured at the pin 74, depending on the depth of engagement of the adjustment screw 78 in the pin 74.

The range of pivotal motion between the arm 60 and the first shroud 24 is the amount of pivotal motion that is possible at the joint (pin 19*c* in the illustrated embodiment) joining the arm 60 and the first shroud 24, and occurring during the full range of motion of the handles 114, the first jaw 14, and the second jaw 16 during use of the tool 10. Rotation of the adjustment screw 78 by a user acts to increase or decrease the available range of motion between the arm 60 and the first shroud 24. Rotation of the adjustment screw 78 by a user also may act to adjust the angular orientation between the arm 60 and the first shroud 24, the angular orientation being the angle between any pair of intersecting lines, the first line lying on or within the arm 60 and the second line lying on or within the first shroud 24. A user may rotate the adjustment screw 78 to adjust the angular orientation between the arm 60 and the first shroud 24 so that when the handles 114 are pushed together, the first jaw 14 and second jaw 16 engage one another in the desired fashion, for example, with the desired pressure.

An adjustment mechanism 12 according to a presently preferred embodiment of the invention optionally includes a washer 92 disposed between the distal bearing surface 90 of the adjustment screw 78 and the outer surface 25 of the first side section 30 of the first shroud 24. Optionally the adjustment mechanism 12 may include a nylon spacer (not shown) disposed on the adjustment screw 78 between the arm 60 and the first shroud 24, so when the tool is in an open position, there is a reduction of the tendency of the distal bearing surface 90 of the adjustment screw 78 to move away from the outer surface 25 of the first shroud 24. This movement, although not harmful, might be perceived by a user as looseness of the tool.

The various components of the tool 10 and adjustment mechanism 12 are preferably formed of metal as is known in the art. However, any materials suited to a particular application of the invention are within the scope of the invention.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the present disclosure.

I claim:

1. An adjustment mechanism for a tool having a first jaw pivotally attached to a second jaw for exerting compressive force therebetween, comprising:

a first shroud comprising a generally trough-shaped first body having a first generally planar front section, a first side section joined to the first front section and having a first aperture therethrough, and a first generally planar back section joined to the first side section, the first side section holding the first front section and the first back section in generally parallel, spaced relation, with a first gap between the first front section and the first back section, the first shroud having a first end portion and a second end portion and being pivotally attached at the first end portion to the first jaw of the tool;

a second shroud comprising a generally trough-shaped second body having a second generally planar front section, a second side section joined to the second front section, and a second generally planar back section joined to the second side section, the second side section holding the second front section and the second back section in generally parallel, spaced relation, with a second gap between the second front section and the second back section, the second shroud having a first end portion and a second end portion and being pivotally attached at the first end portion to the second jaw of the tool;

an arm having a first end portion, a second end portion, a medial portion disposed generally between the first end portion and the second end portion, and an outer periphery, the arm being disposed in the first gap and being pivotally attached to the first shroud at the medial portion of the arm to have a first range of pivotal motion between the arm and the first shroud and a first angular orientation between the arm and the first shroud, the arm having a pin mount in the second end portion thereof and a slot communicating with the outer periphery and intersecting the pin mount, the slot being aligned with the first aperture of the first side section, and the arm being further disposed in the second gap and being pivotally attached to the second shroud at the first end portion of the second shroud;

a pin with a threaded aperture, the pin being rotatably mounted in the pin mount of the arm with the threaded aperture aligned with the slot;

an adjustment screw having a threaded portion, a proximal end, a distal end, and a screw head at the proximal end, the screw head having a distal head portion, and a distal bearing surface at the distal head portion, the distal end of the adjustment screw passing through the first aperture of the first shroud and the slot of the arm and threadedly engaging the threaded aperture of the pin with the threaded portion of the adjustment screw, and the distal bearing surface being restrained by the first side section of the first shroud, such that upon rotation of the adjustment screw, at least one of the first range of pivotal motion between the arm and the first shroud and the first angular orientation between the arm and the first shroud is adjusted.

2. The adjustment mechanism of claim 1, further comprising a washer disposed between the distal bearing surface and the outer surface of the first side section of the first shroud.

3. The adjustment mechanism of claim 1, wherein the first front section, the first side section, and the first back section of the first shroud form a continuous body having a generally U-shaped cross section.

4. The adjustment mechanism of claim 3, wherein the second front section, the second side section, and the second back section of the second shroud form a continuous body having a generally U-shaped cross section.

5. The adjustment mechanism of claim 1, wherein the second front section, the second side section, and the second back section of the second shroud form a continuous body having a generally U-shaped cross section.

6. The adjustment mechanism of claim 1, wherein the arm comprises a first generally planar body of generally uniform thickness having the pin mount and the slot therein, the first end portion of the arm has a generally trapezoidal shape, the second end portion of the arm has a generally trapezoidal shape that is rounded at the second end, the arm is pivotally attached to the first shroud by a first pivotal connector passing through the first front section and the first back section of the first shroud and transversely through the medial portion of the arm, and the arm is pivotally attached to the second shroud by a second pivotal connector passing through the second front section and the second back section of the second shroud and transversely through the medial portion of the arm.

7. The adjustment mechanism of claim 6, wherein the second jaw is pivotally attached to the second shroud by a third bolt passing through the second front section and the second back section of the second shroud and through the second jaw.

8. The adjustment mechanism of claim 1, wherein the slot has an inner span and the adjustment screw has an outer diameter, and the inner span of the slot is greater than the outer diameter of the adjustment screw such that the adjustment screw pivots through a range of motion within the slot and the first aperture.

9. The adjustment mechanism of claim 8, wherein the range of motion between the adjustment screw and the slot is in the range of about 15 to 20 degrees.

10. The adjustment mechanism of claim 1, wherein the arm comprises a first generally planar body of generally uniform thickness having a pin mount, an outer periphery, a generally planar first interior portion, a semi-slot formed in the first interior portion and communicating with the pin mount and with the outer periphery of the first body, a second generally planar body of generally uniform thickness having a pin mount aligned with the pin mount of the first body, an outer periphery at least partially aligned with the outer periphery of the first body, a generally planar second interior portion, a semi-slot formed in the second interior portion and communicating with the pin mount and with the outer periphery of the second body, wherein the first interior planar portion and the second interior planar portion are adjacent, and the semi-slot formed in the first interior portion and semi-slot formed in the second interior portion are aligned to form the slot communicating with the pin mount and with the outer periphery of the arm, and the pin mount of the first body and the pin mount of the second body are aligned and together form the pin mount of the arm, and wherein the pin has a first end and a second end, and the first end engages the pin mount of the first generally planar body, and the second end engages the pin mount of the second generally planar body.

11. The adjustment mechanism of claim 10, wherein each semi-slot has a first intersection and a second intersection with the outer periphery of the respective planar body, so that the slot passes entirely through the arm.

12. The adjustment mechanism of claim 10, wherein the pin mount of the first body, the pin mount of the second body, and the pin mount of the arm are holes passing entirely through the first body, second body, and arm respectively.

13. The adjustment mechanism of claim 1, wherein the slot passes entirely through the arm.

14. The adjustment mechanism of claim 1, further comprising a first actuator arm attached to the second end portion of the first shroud and a second actuator arm attached to the second end portion of the second shroud.

15. The adjustment mechanism of claim 1, wherein the pin mount comprises one of a depression, a socket, and a hole.

* * * * *